US011519658B1

(12) United States Patent
Wu et al.

(10) Patent No.: US 11,519,658 B1
(45) Date of Patent: Dec. 6, 2022

(54) REFRIGERATING APPARATUS APPLIED TO REFRIGERATOR

(71) Applicant: Wuyi University, Jiangmen (CN)

(72) Inventors: Min Wu, Jiangmen (CN); Yijia Wu, Jiangmen (CN); Ji Wu, Jiangmen (CN); Shuo Chen, Jiangmen (CN)

(73) Assignee: WUYI UNIVERSITY, Jiangmen (CN)

( * ) Notice: Subject to any disclaimer, the term of this patent is extended or adjusted under 35 U.S.C. 154(b) by 50 days.

(21) Appl. No.: 17/360,494

(22) Filed: Jun. 28, 2021

(30) Foreign Application Priority Data

May 27, 2021 (CN) ..... 202110583047.5

(51) Int. Cl.

| | |
|---|---|
| ***F25D 11/02*** | (2006.01) |
| ***F25D 17/00*** | (2006.01) |
| ***F25D 29/00*** | (2006.01) |
| ***F25D 17/06*** | (2006.01) |
| ***F25D 17/04*** | (2006.01) |

(52) U.S. Cl.
CPC ..... *F25D 11/02* (2013.01); *F25D 17/00* (2013.01); *F25D 17/042* (2013.01); *F25D 17/065* (2013.01); *F25D 29/001* (2013.01)

(58) Field of Classification Search
CPC ..... F25B 9/12; F25B 2400/23; F25D 17/00; F25D 17/042; F25D 17/065; F25D 29/001
See application file for complete search history.

(56) References Cited

U.S. PATENT DOCUMENTS

2007/0113581 A1* 5/2007 Yoshimi ..... F25B 43/043 62/512

* cited by examiner

*Primary Examiner* — Cassey D Bauer
(74) *Attorney, Agent, or Firm* — Vivacqua Crane, PLLC

(57) ABSTRACT

A refrigerating apparatus applied to a refrigerator is disclosed. The refrigerating apparatus includes a refrigerant, a depressurization gas, an evaporator, a condenser, a first connecting pipe, a second connecting pipe, a third connecting pipe, a blower device and a refrigerator body. The evaporator is provided with an inlet and an outlet; the condenser is provided with a condensation cavity, a gas inlet, a gas outlet and a liquid outlet; a molecular sieve membrane is disposed in the condensation cavity; one end of the first connecting pipe is connected to the outlet and the other end to the gas inlet; one end of the second connecting pipe is connected to the liquid outlet and the other end to the inlet; one end of the third connecting pipe is connected to the gas outlet and the other end to the inlet.

10 Claims, 2 Drawing Sheets

REFRIGERATING APPARATUS APPLIED TO REFRIGERATOR

CROSS-REFERENCE TO RELATED APPLICATIONS

This application is based on and claims the benefit of priority from Chinese Patent Application No. 202110583047.5, filed on 27 May 2021, the entirety of which is incorporated by reference herein.

TECHNICAL FIELD

The present disclosure relates to the technical field of refrigeration, in particular to a refrigerating apparatus applied to a refrigerator.

BACKGROUND

The traditional refrigeration process adopts a compressor for compression to realize condensation of a freezing medium or adopts liquid to absorb a freezing medium, and the energy consumption of the two modes is very high.

SUMMARY

According to several embodiments of the present disclosure, a refrigerating apparatus applied to a refrigerator is provided, which can realize refrigeration with lower power consumption.

The refrigerating apparatus applied to the refrigerator according to an embodiment of the present disclosure includes:

a refrigerant disposed in a pipeline of the refrigerating apparatus, the refrigerant including at least one of R290, R32, R404A or R410A;

a depressurization gas disposed in the pipeline of the refrigerating apparatus, the depressurization gas including at least one of hydrogen or helium;

an evaporator provided with an inlet and an outlet;

a condenser provided with a condensation cavity, a gas inlet, a gas outlet and a liquid outlet, wherein a molecular sieve membrane is disposed in the condensation cavity between the gas inlet and the gas outlet, and the molecular sieve membrane is configured to separate a mixed gas composed of the refrigerant and the depressurization gas;

a first connecting pipe having one end connected to the outlet and the other end connected to the gas inlet;

a second connecting pipe having one end connected to the liquid outlet and the other end connected to the inlet;

a third connecting pipe having one end connected to the gas outlet and the other end connected to the inlet;

a blower device communicated with the first connecting pipe and configured to introduce the mixed gas into the condensation cavity;

wherein the refrigerating apparatus has a system pressure set to be greater than a saturation pressure of the refrigerant at 40° C.; and a refrigerator body provided with a refrigerating chamber and a freezing chamber, wherein the evaporator is located at a position in the refrigerator body corresponding to the refrigerating chamber and the freezing chamber, the condenser is located at a lower part of the refrigerator body, and the blower device is located below the refrigerating chamber and the freezing chamber.

The refrigerating apparatus applied to the refrigerator according to the embodiment of the present disclosure at least has the following beneficial effects. The liquid refrigerant and the depressurization gas are mixed by the evaporator, and the surface pressure of the liquid refrigerant is reduced, so that the liquid refrigerant generates vapor and undergoes a new dynamic balance process to realize the evaporation of the refrigerant. The refrigerant and the depressurization gas are separated by the molecular sieve membrane, and the refrigerant is condensed after reaching a certain concentration to form the liquid refrigerant, and enters the evaporator again for refrigeration. The refrigerating apparatus applied to the refrigerator changes a traditional refrigeration cycle mode, and the energy consumption required in the condensation process is lower, so that the production cost of the refrigerating apparatus is reduced, and the economic benefit is higher. The refrigeration requirements of the refrigerator can be met by reasonably arranging the positions of the evaporator, the condenser and the blower device in the refrigerator body and selecting reasonable types of refrigerant and depressurization gas.

According to some embodiments of the present disclosure, a port of the third connecting pipe stretches into the second connecting pipe and protrudes beyond an inner wall of the second connecting pipe.

According to some embodiments of the present disclosure, the second connecting pipe includes a liquid storage section including a plurality of U-shaped pipes.

According to some embodiments of the present disclosure, the refrigerating apparatus further includes a heat dissipation device configured to dissipate heat from the condenser.

According to some embodiments of the present disclosure, the heat dissipation device includes a cooling water pipe wound around the outside of the condenser.

According to some embodiments of the present disclosure, the system pressure of the refrigerating apparatus is set to be twice the saturation pressure of the refrigerant at 40° C.

According to some embodiments of the present disclosure, when the refrigerant is R290, the system pressure of the refrigerating apparatus is set to 28 Bar.

According to some embodiments of the present disclosure, when the refrigerant is R32, the system pressure of the refrigerating apparatus is set to 50 Bar.

According to some embodiments of the present disclosure, when the refrigerant is R404A, the system pressure of the refrigerating apparatus is set to 36 Bar.

According to some embodiments of the present disclosure, wherein when the refrigerant is R410A, the system pressure of the refrigerating apparatus is set to 40 Bar.

Additional aspects and advantages of the present disclosure will be partially set forth in the description below, and partially will become apparent from the description below or will be learned through the practice of the present disclosure.

BRIEF DESCRIPTION OF THE DRAWINGS

The present disclosure will be further described below with reference to the accompanying drawings and embodiments, in which.

Figure 1:
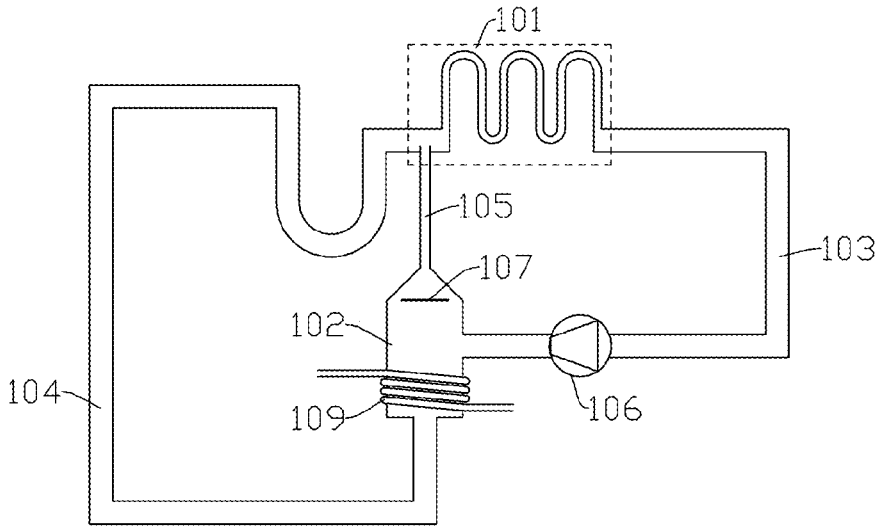
FIG. 1 is a schematic diagram of refrigeration of an embodiment of the present disclosure.

Reference numerals are as follows:

101, evaporator; 102, condenser; 103, first connecting pipe; 104, second connecting pipe; 105, third connecting pipe; 106, blower device; 107, molecular sieve membrane; 108, liquid storage section; 109, heat dissipation device; 301, freezing chamber; 302, refrigerating chamber.

DETAILED DESCRIPTION

The embodiments of the present disclosure are described in detail below, examples of which are illustrated in the accompanying drawings, in which like or similar reference numerals refer to the same or similar elements or elements having the same or similar function throughout. The embodiments described below by reference to the accompanying drawings are exemplary only for explaining the present disclosure and are not to be construed as limiting the present disclosure.

In the description of the present disclosure, it is to be understood that the orientation or positional relationship, such as up, down, front, back, left, right, etc., referred to as orientation description is based on the orientation or positional relationship shown in the accompanying drawings, and is only for convenience of description of the present disclosure and simplification of description. It is not intended to indicate or imply that the apparatus or element referred to must have a particular orientation, be constructed and operate in a particular orientation, and thus is not to be construed as a limitation on the present disclosure.

In the description of the present disclosure, the meaning of a plurality is one or more, the meaning of a plurality is two or more, greater than, less than, more than, and the like are understood to be exclusive of the present number, and above, below, within, and the like are understood to be inclusive of the present number. If first and second are described, only for the purpose of distinguishing technical features and cannot be understood to indicate or imply relative importance or to imply a number of the indicated technical features or to imply a precedence of the indicated technical features.

In the description of the present disclosure, unless expressly defined otherwise, the terms of arrangement, installation, connection and the like are to be understood broadly, and the specific meaning of the words in the present disclosure may reasonably be determined by those skilled in the art in conjunction with the particulars of the technical solution.

Referring to FIG. 1, a refrigerating apparatus applied to a refrigerator of an embodiment of the present disclosure includes an evaporator 101, a condenser 102, a first connecting pipe 103, a second connecting pipe 104, a third connecting pipe 105 and a blower device 106. The evaporator 101 is provided with an inlet and an outlet. The condenser 102 is provided with a condensation cavity, a gas inlet, a gas outlet and a liquid outlet. A molecular sieve membrane 107 is disposed in the condensation cavity between the gas inlet and the gas outlet and is configured to separate a mixed gas. One end of the first connecting pipe 103 is connected to the outlet, and the other end of the first connecting pipe 103 is connected to the gas inlet. One end of the second connecting pipe 104 is connected to the liquid outlet, and the other end of the second connecting pipe 104 is connected to the inlet. One end of the third connecting pipe 105 is connected to the gas outlet, and the other end of the third connecting pipe 105 is connected to the inlet. The blower device 106 is communicated with the first connecting pipe 103 and is configured to introduce the mixed gas into the condensation cavity.

A refrigerant and a depressurization gas are injected into the refrigerating apparatus, and refrigeration circulation is achieved through circulation conversion between a gas state and a liquid state of the refrigerant.

Specifically, the liquid refrigerant and the depressurization gas are mixed in the evaporator 101. The evaporator 101 provides a space for evaporation in a position where the liquid refrigerant and the depressurization gas start to mix, and there is no gas refrigerant in this position, that is, the partial pressure of the gas refrigerant is zero, and therefore the liquid refrigerant is necessarily evaporated to forming the gas refrigerant. In this process, the evaporator 101 absorbs heat in the air to effect refrigeration.

The gas refrigerant and the depressurization gas are mixed in the evaporator 101 to form a mixed gas, and the mixed gas flows into the condenser 102 along a system. The blower device 106 is configured to introduce the mixed gas into the condensation cavity of the condenser 102. The molecular sieve membrane 107 is disposed in the condensation cavity. The molecular sieve membrane 107 is defined as a novel membrane material capable of realizing molecular sieving, which has a uniform pore diameter equivalent to the molecular size, ion exchange performance, high-temperature thermal stability and excellent shape-selective catalytic performance, is easy to modify, and has various different types and different structures for selection. The molecular sieve membrane 107 is configured to allow the passage of the depressurization gas while preventing the passage of the refrigerant, thereby achieving the effect of separating the mixed gas.

For example, the refrigerant is selected to be ammonia, and the depressurization gas is selected to be hydrogen or helium. The hydrogen has a molecular diameter of 0.289 nm, i.e., 2.89 A. The helium has a molecular diameter of 0.26 nm, that is, 2.6 A. The ammonia has a molecular diameter of 0.444 nm, that is, 4.44 A. Therefore, hydrogen and ammonia can be effectively separated, or helium and ammonia can be effectively separated by selecting the molecular sieve membrane 107 of 3 A or 4 A.

The nature of liquefaction of the gas refrigerant is that the gas refrigerant is necessarily liquefied after the relative humidity of the gas refrigerant reaches 100%. Thus, after the mixed gas is separated, only the gas refrigerant remains in part of the condensation cavity, or both the gas refrigerant and the liquid refrigerant exist in the condensation cavity. When the mixed gas is continuously introduced into the condensation cavity of the condenser 102 by the blower device 106, the gas refrigerant is condensed into the liquid refrigerant after the relative humidity of the gas refrigerant reaches 100%.

Microscopically, evaporation is the process of liquid molecules leaving the liquid surface. As molecules in the liquid are moving irregularly and continuously, the average kinetic energy of the molecules is matched with the temperature of the liquid. Due to the irregular motion and mutual collisions of the molecules, there are always molecules having kinetic energy greater than the average kinetic energy at any moment. These molecules with sufficiently large kinetic energy, such as those located near the liquid surface, can break away from the liquid surface and fly out to become vapor of the liquid when their kinetic energy is greater than the work required to overcome the attraction between the molecules in the liquid when flying out, which is an evaporation phenomenon. The flying-out molecules may return to the liquid surface or enter the interior of the liquid after colliding with other molecules. If more molecules fly out than back, the liquid evaporates. The more molecules in the space, the more molecules fly back. When the flying-out molecules are equal to the flying-back molecules, the liquid is in a saturated state, and the pressure at this time is called the saturation pressure Pt of the liquid at that temperature. At this time, if the number of gas molecules of the substance in the space is artificially increased, the flying-back molecules will be more than the flying-out molecules, and condensation will occur.

The liquid refrigerant and the depressurization gas are mixed by the evaporator 101. The surface pressure of the liquid refrigerant is reduced, so that the liquid refrigerant generates vapor and undergoes a new dynamic equilibrium process to achieve evaporation of the refrigerant. The molecular sieve membrane 107 is used again to separate the refrigerant from the depressurization gas. The refrigerant is condensed to a liquid refrigerant after reaching a certain concentration and enters the evaporator 101 again for refrigeration. The refrigerating apparatus applied to the refrigerator changes a traditional refrigeration cycle mode, and the energy consumption required in the condensation process is lower, so that the production cost of the refrigerating apparatus is reduced, and the economic benefit is higher.

Figure 2:
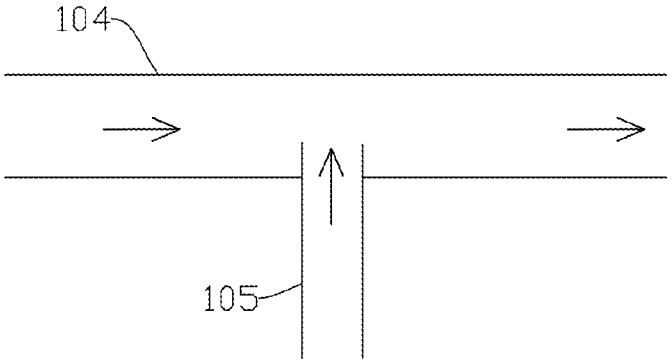
FIG. 2 is a schematic diagram of connection between a third connecting pipe and a second connecting pipe shown in FIG. 1.

Referring to FIG. 2, in some embodiments, a port of the third connecting pipe 105 stretches into the second connecting pipe 104 and protrudes beyond an inner wall of the second connecting pipe 104. Liquid ammonia enters from the left side, hydrogen enters from the lower side, and the port of the third connecting pipe 105 protrudes beyond the inner wall of the second connecting pipe 104, so that the possibility that the liquid ammonia flows backwards into the condenser 102 from the third connecting pipe 105 can be reduced.

According to some embodiments of the present disclosure, the second connecting pipe 104 includes a liquid storage section 108, and the liquid storage section 108 includes a plurality of U-shaped pipes. By disposing the U-shaped pipes, more refrigerant can be stored, and a space occupied by the second connecting pipe 104 is reduced.

According to some embodiments of the present disclosure, the refrigerating apparatus further includes a heat dissipation device 109 configured to dissipate heat from the condenser 102. By disposing the heat dissipation device 109, the heat dissipation efficiency of the condenser 102 can be effectively improved, and then the condensation efficiency is improved.

According to some embodiments of the present disclosure, the heat dissipation device 109 includes a cooling water pipe wound around the outside of the condenser 102. The cooling water pipe may utilize a normal-temperature water source which is easily available. It will be understood that the heat dissipation device 109 may also employ an air-cooled device instead of or in combination with a cooling water pipe.

According to some embodiments of the present disclosure, an inlet of the cooling water pipe is higher than an outlet of the cooling water pipe, so that water flow is facilitated, the flow rate is increased, and heat exchange is accelerated.

According to some embodiments of the present disclosure, the gas outlet is located in an upper part of the condenser 102, the liquid outlet is located in a lower part of the condenser 102, and the gas inlet is located in the middle of the condenser 102. The depressurization gas is lighter than the refrigerant and flows upwards, and the gas outlet is located in the upper part of the condenser 102 to facilitate outflow of the depressurization gas. The liquid outlet is located in the lower part of the condenser 102 to facilitate the outflow of the liquefied refrigerant.

According to some embodiments of the present disclosure, the condenser 102 includes a conical guiding portion. The gas outlet is located at a small end of the conical guiding portion. By disposing the conical guiding portion, depressurization gas is guided to flow out of the gas outlet, and flow loss is reduced.

According to some embodiments of the present disclosure, the blower device 106 includes a ventilator. The ventilator does not need to have a compression ratio as large as that of a compressor of a conventional refrigerating apparatus. The ventilator only needs to introduce the mixed gas into the condenser 102, and condensation is achieved by the change of the concentration of the refrigerant itself. Certainly, the blower device 106 may also be a compressor which may have a power less than that of conventional compressors.

Figure 3:
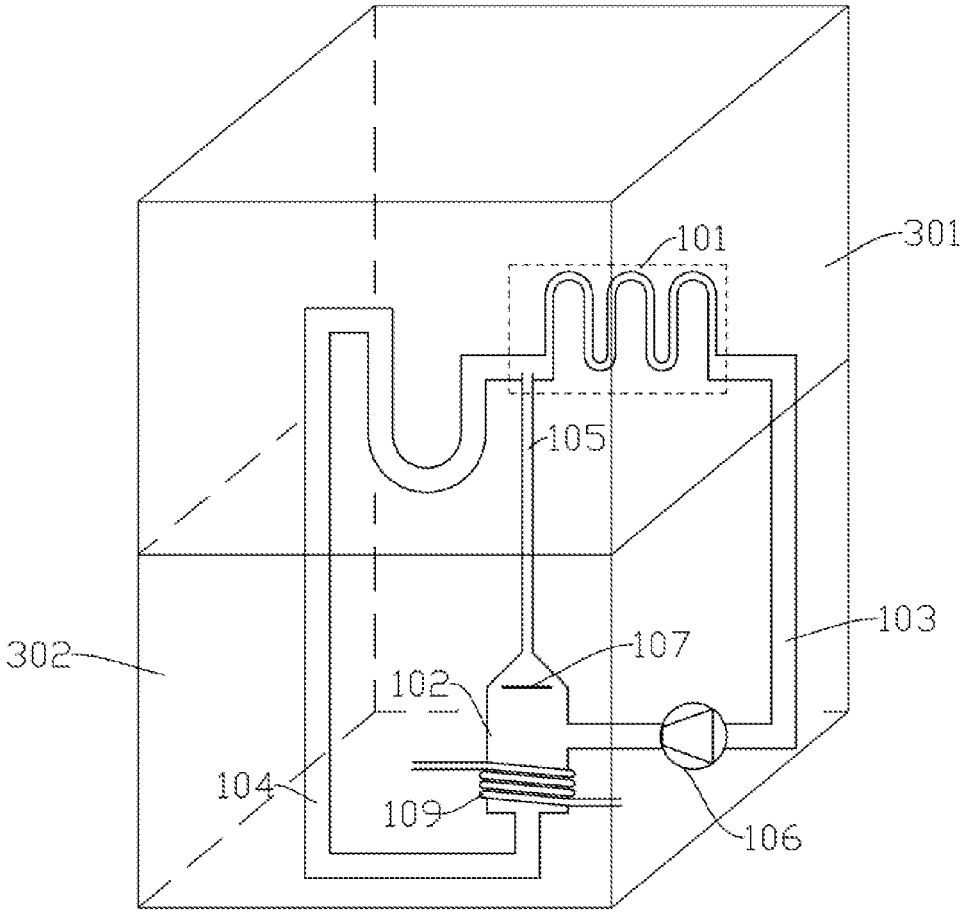
FIG. 3 is a schematic diagram of a refrigerating apparatus applied to a refrigerator of an embodiment of the present disclosure.

Referring to FIG. 3, it will be understood that the refrigerator includes a refrigerator body, and the refrigerator body includes a freezing chamber 301 and a refrigerating chamber 302. The evaporator 101 is located at a position in the refrigerator body corresponding to the refrigerating chamber 302 and the freezing chamber 301 to facilitate refrigeration and reduce cold loss. It will be understood that the evaporator 101 can be directly cooled or air cooled.

The condenser 102 is located at a lower part of the refrigerator body, so as to be conveniently connected to cooling water.

The blower device 106 is located below the refrigerating chamber 302 and the freezing chamber 301, so that the space at the lower part of the case is conveniently utilized, and meanwhile vibration noise is reduced.

The refrigerator is a refrigerating apparatus keeping constant low temperature, and is also a civil product keeping food or other articles in a constant low temperature state. Although the basic working principle of the present invention has been introduced above, creative labor is still needed to select a solution suitable for the refrigerator, otherwise, too high or too low refrigerating temperature may be caused, and the using requirement of the refrigerator cannot be met.

After constant screening and verification, the present disclosure proposes that, in some embodiments, the refrigerant includes at least one of R290 (propane), R32 (difluoromethane), R404A (pentafluoroethane/trifluoroethane/tetrafluoroethane mixture), or R410A (consisting of two quasi-azeotropic mixtures R32 and R125, each 50%), and the depressurization gas includes at least one of hydrogen or helium.

Refer to the table below, which presents the relationship between system pressure and cold end refrigeration temperature required for different refrigerants.

| Refrigerant | Saturation pressure corresponding to 40° C. | System pressure | Cold-end refrigeration temperature |
|---|---|---|---|
| R290 | 14 Bar | 28 Bar | −25° C. to 5° C. |
| R32 | 25 Bar | 50 Bar | −23° C. to 5° C. |
| R404A | 18 Bar | 36 Bar | −20° C. to 5° C. |
| R410A | 20 Bar | 40 Bar | −24° C. to 5° C. |

The working process of the refrigerating apparatus applied to the refrigerator in the embodiment of the present disclosure is illustrated by taking R290 as the refrigerant and hydrogen as the depressurization gas.

A mixed gas of R290 gas and hydrogen is introduced into the condensation cavity from a gas inlet of the condenser 102 under the action of the blower device 106. The hydrogen passes through the molecular sieve membrane 107 and flows out of the gas outlet. The R290 gas is blocked by the molecular sieve membrane 107 and accumulates in the condensation cavity. When the concentration of the R290 gas is constantly increased, according to the h-s diagram (pressure enthalpy diagram) of R290 gas, the saturation pressure Pt of R290 is 14 bar at 40° C., and a standby pressure of the refrigerating apparatus is set to be 2 Pt, that is, 28 bar, so that the concentration of the R290 gas in the condenser 102 is continuously increased. When the concentration reaches 50%, that is, the partial pressure of the R290 gas reaches 1 Pt, the R290 gas starts to condense to form liquid R290. The liquid R290 flows out of the liquid outlet. The liquid R290 enters the evaporator 101 along the second connecting pipe 104, the hydrogen enters the evaporator 101 along the third connecting pipe 105, and the liquid R290 and the hydrogen are mixed in the evaporator 101. In the evaporator 101, because the hydrogen is light and fills the evaporator 101, the partial pressure of the gas R290 is close to 0, so that the liquid R290 will have molecules entering the hydrogen to form R290 gas, i.e., the liquid R290 will evaporate. The R290 gas and the hydrogen are mixed and then enter the condenser 102 along the first connecting pipe 103 to realize circulation. In this embodiment, the cold end refrigeration temperature is −25° C. to 5° C.

It should be noted that the higher the temperature corresponding to the saturation pressure of the selected refrigerant is, the greater the system pressure is required, while the lower the temperature is, the higher the heat dissipation requirements for the condenser 102 is, which increases the manufacturing cost. Multiple tests prove that when the temperature is selected to be 40° C., the system pressure and heat dissipation requirements can be balanced, and the cost is effectively reduced.

In addition, the system pressure of the refrigerating apparatus should be set to be larger than the saturation pressure of the refrigerant at 40° C., and when the system pressure of the refrigerating apparatus is set to be twice the saturation pressure of the refrigerant at 40° C., the refrigeration cycle efficiency can be further improved, the refrigeration time can be shortened, and meanwhile the manufacturing difficulty and cost will not be greatly increased.

Although embodiments of the present disclosure have been described in detail above with reference to the accompanying drawings, the present disclosure is not limited to the embodiments described above, and various modifications can be made without departing from the nature of the present disclosure within the knowledge of those skilled in the art.

We claim:

1. A refrigerating apparatus applied to a refrigerator, comprising:

a refrigerant disposed in a pipeline of the refrigerating apparatus, the refrigerant comprising at least one of R290, R32, R404A or R410A;

a depressurization gas disposed in the pipeline of the refrigerating apparatus, the depressurization gas comprising at least one of hydrogen or helium;

an evaporator provided with an inlet and an outlet;

a condenser provided with a condensation cavity, a gas inlet, a gas outlet and a liquid outlet, wherein a molecular sieve membrane is disposed in the condensation cavity between the gas inlet and the gas outlet, and the molecular sieve membrane is configured to separate a mixed gas composed of the refrigerant and the depressurization gas;

a first connecting pipe having one end connected to the outlet and the other end to the gas inlet;

a second connecting pipe having one end connected to the liquid outlet and the other end to the inlet;

a third connecting pipe having one end connected to the gas outlet and the other end to the inlet;

a blower device communicated with the first connecting pipe and configured to introduce the mixed gas into the condensation cavity;

wherein the refrigerating apparatus has a system pressure set to be greater than a saturation pressure of the refrigerant at 40° C.; and a refrigerator body provided with a refrigerating chamber and a freezing chamber, wherein the evaporator is located at a position in the refrigerator body corresponding to the refrigerating chamber and the freezing chamber, the condenser is located at a lower part of the refrigerator body, and the blower device is located below the refrigerating chamber and the freezing chamber.

2. The refrigerating apparatus according to claim 1, wherein a port of the third connecting pipe stretches into the second connecting pipe and protrudes beyond an inner wall of the second connecting pipe.

3. The refrigerating apparatus according to claim 1, wherein the second connecting pipe comprises a liquid storage section comprising a plurality of U-shaped pipes.

4. The refrigerating apparatus according to claim 1, wherein the refrigerating apparatus further comprises a heat dissipation device configured to dissipate heat from the condenser.

5. The refrigerating apparatus according to claim 4, wherein the heat dissipation device comprises a cooling water pipe wound around the outside of the condenser.

6. The refrigerating apparatus according to claim 1, wherein the system pressure of the refrigerating apparatus is set to be twice the saturation pressure of the refrigerant at 40° C.

7. The refrigerating apparatus according to claim 1, wherein when the refrigerant is R290, the system pressure of the refrigerating apparatus is set to 28 Bar.

8. The refrigerating apparatus according to claim 1, wherein when the refrigerant is R32, the system pressure of the refrigerating apparatus is set to 50 Bar.

9. The refrigerating apparatus according to claim 1, wherein when the refrigerant is R404A, the system pressure of the refrigerating apparatus is set to 36 Bar.

10. The refrigerating apparatus according to claim 1, wherein when the refrigerant is R410A, the system pressure of the refrigerating apparatus is set to 40 Bar.

* * * * *